US011336049B1

(12) United States Patent
Levis et al.

(10) Patent No.: US 11,336,049 B1
(45) Date of Patent: May 17, 2022

(54) SEALED ELECTRICAL CONNECTOR AND METHOD OF SEALING

(71) Applicant: Amphenol Corporation, Wallingford, CT (US)

(72) Inventors: Brennen Chambers Levis, Binghamton, NY (US); Richard Lewis Barnes, Jr., Unadilla, NY (US)

(73) Assignee: AMPHENOL CORPORATION, Wallingford, CT (US)

( * ) Notice: Subject to any disclaimer, the term of this patent is extended or adjusted under 35 U.S.C. 154(b) by 21 days.

(21) Appl. No.: 17/085,818

(22) Filed: Oct. 30, 2020

(51) Int. Cl.

| | |
|---|---|
| ***H01R 13/52*** | (2006.01) |
| ***H01R 13/622*** | (2006.01) |
| ***H01R 13/502*** | (2006.01) |
| ***H01R 13/42*** | (2006.01) |

(52) U.S. Cl.
CPC ..... *H01R 13/5202* (2013.01); *H01R 13/42* (2013.01); *H01R 13/502* (2013.01); *H01R 13/622* (2013.01)

(58) Field of Classification Search
CPC .. H01R 13/5202; H01R 13/42; H01R 13/502; H01R 13/622
See application file for complete search history.

(56) References Cited

U.S. PATENT DOCUMENTS

| | | | | |
|---|---|---|---|---|
| 3,678,776 | A | 7/1972 | Patterson | |
| 4,052,076 | A | 10/1977 | Wysong | |
| 4,082,398 | A * | 4/1978 | Bourdon | H01R 13/4226 439/595 |
| 5,324,047 | A | 6/1994 | Organ et al. | |
| 5,681,177 | A * | 10/1997 | Mikolaicyk | H01R 13/622 285/354 |
| 6,523,833 | B1 | 2/2003 | Ishigaki et al. | |
| 6,558,180 | B2 | 5/2003 | Nishimoto | |
| 6,957,972 | B2 | 10/2005 | Starke et al. | |
| 7,824,214 | B2 | 11/2010 | Paynter | |
| 2010/0059995 | A1 * | 3/2010 | Ciprich | F16L 19/045 285/341 |
| 2016/0036174 | A1 * | 2/2016 | Montena | H01R 9/05 439/583 |

FOREIGN PATENT DOCUMENTS

| | | |
|---|---|---|
| CN | 203911086 | 10/2014 |
| EP | 2595248 | 5/2013 |
| JP | 9092375 | 4/1997 |
| KR | 101723041 | 4/2017 |

* cited by examiner

*Primary Examiner* — Abdullah A Riyami
*Assistant Examiner* — Nader J Alhawamdeh
(74) *Attorney, Agent, or Firm* — Cantor Colburn LLP

(57) ABSTRACT

An electrical connector includes a coupling nut configured to at least partially surround a connector body. The coupling nut includes a first end and a second opposing end. The first end is configured to interface with a mating connector. The coupling nut further includes an inner thread portion located between the first and second ends; and a sealing member located at the first end. The sealing member has a base and a deformable wiper portion. The sealing member is configured to flex between deformed and non-deformed states when coupling the coupling nut to the mating connector. The base of the sealing member is in contact with an inner surface of the first end and the deformable wiper portion extends radially inwardly from the base.

26 Claims, 10 Drawing Sheets

200

200

SEALED ELECTRICAL CONNECTOR AND METHOD OF SEALING

BACKGROUND

This disclosure relates generally to the field of electrical connectors and more particularly to sealed electrical connectors and methods of sealing the same.

Electrical connectors have a variety of applications, including applications in salt spray/corrosive atmospheres. Corrosive agents may enter the area of mating threads of electrical connectors and corrode the mating threads of the electrical connectors. Accordingly, the mating interfaces of the connectors can be compromised and the lifetime of the connectors may be reduced.

SUMMARY

An aspect of this disclosure is an electrical connector. The electrical connector includes a coupling nut configured to at least partially surround a connector body. The coupling nut includes a first end and a second opposing end. The first end is configured to interface with a mating connector. The coupling nut further includes an inner thread portion located between the first and second ends; and a sealing member located at the first end. The sealing member has a base and a deformable wiper portion. The sealing member is configured to flex between deformed and non-deformed states when coupling the coupling nut to the mating connector. The base of the sealing member is in contact with an inner surface of the first end and the deformable wiper portion extends radially inwardly from the base.

In some examples, the first end of the coupling nut includes an inner groove that has a base wall, two side walls, and an opening. The base wall, the two side walls, and the opening define a receiving area that is sized and shaped to receive the base of the sealing member. The base of the sealing member is in contact with the base wall of the inner groove, and the deformable wiper portion of the sealing member extends out from the opening of the groove.

In another example, the two side walls of the inner groove taper inwardly toward one another.

In yet another example, the two side walls of the inner groove are substantially parallel to one another.

In certain examples, the first end of the coupling nut has a mating face. The second end of the coupling nut has a tail face. A distance between the sealing member and the mating face of the coupling nut is smaller than a distance between the sealing member and the tail face of the coupling nut.

In other examples, the distance between the sealing member and the mating face of the coupling nut is equal to or less than approximately one-ninth of a distance between the mating and tail faces.

In another example, the deformable wiper portion of the sealing member includes a tapered edge facing inwardly away from the base of the sealing member.

In yet another example, a cross-section of the sealing member is substantially triangular in shape.

In certain examples, the sealing member is positioned between the inner thread portion and a mating face of the first end along a longitudinal axis of the coupling nut.

Another aspect of this disclosure is an electrical connector assembly. The electrical connector assembly includes a first electrical connector and a second electrical connector. The first electrical connector (e.g., a plug connector) includes a body and a coupling nut. The coupling nut at least partially surrounds the body and has a longitudinal axis. The coupling nut includes a first end and a second opposing end, an inner thread portion located between the first and second ends, and a sealing member located at the first end. The sealing member has a base and a deformable wiper portion. The base of the sealing member is in contact with an inner surface of the first end, and the deformable wiper portion extends radially inwardly from the base. The second electrical connector (e.g. a receptacle connector) includes a shell. The shell has a first end with outer threads, and an opposing second end, the first end being configured to mate with the coupling nut of the first electrical connector. The inner thread portion of the coupling nut mates with the outer threads of the first end of the second electrical connector. When mating the first and second electrical connectors, the sealing member is configured to flex between deformed and non-deformed states and the deformable wiper portion of the sealing member of the coupling nut is in contact with an outer surface of the shell of the second electrical connector.

In some examples, when in the non-deformed state, the deformable wiper portion of the sealing member contacts the outer surface at a position axially spaced from and behind the outer threads of the shell of the second electrical connector.

In another example, wherein when in the deformed state, the deformable wiper portion of the sealing member of the coupling nut is in contact with the outer surface at the outer threads of the shell of the second electrical connector.

In yet another example, the first end of the coupling nut includes an inner groove including a base wall, two sides walls, and an opening, thereby defining a receiving area that is sized and shaped to receive the base of the sealing member. The base of the sealing member is in contact with the base wall of the inner groove, and the deformable wiper portion extends out from the opening of the groove.

In certain examples, the two side walls taper inwardly toward one another.

In other examples, the first end of the coupling nut has a mating face; the second end of the coupling nut has a tail face; and a distance between the sealing member and the mating face of the coupling nut is smaller than a distance between the sealing member and the tail face of the coupling nut.

In another example, the distance between the sealing member and the mating face of the coupling nut is equal to or less than approximately one-ninth of a distance between the mating and tail faces of the coupling nut.

In yet another example, the deformable wiper portion of the sealing member includes a tapered edge facing inwardly away from the base of the seal.

In certain examples, a tip of the tapered edge is in a substantially circular shape across a plane orthogonal to the longitudinal axis of the coupling nut.

In other examples, a cross-section of the sealing member is substantially triangular in shape.

In another example, when in the non-deformed state, the deformable wiper portion of the sealing member is axially spaced apart from and behind the outer threads of the first end of the shell of the second electrical connector along the longitudinal axis of the coupling nut.

Another aspect of this disclosure is a method of sealing an electrical connector assembly. The method includes mating first (e.g., a plug connector) and second (e.g., a receptacle connector) electrical connectors by coupling a coupling nut of the first electrical connector with the second electrical connector, thereby defining a mating interface of the assembly. The coupling nut includes a first end and a second opposing end, an inner thread portion between the first and second ends, and a sealing member at the first end and having a base and a deformable wiper portion that is configured to flex between deformed and non-deformed states when mating the first and second electrical connectors. The second electrical connector includes a shell having a first end having outer threads on an outer surface of the first end and an opposing second end, and an intermediate portion between the first and second ends and having an outer surface spaced axially apart from the threads of the first end of second electrical connector. The method further includes threading the coupling nut onto the first end of the second electrical connector to deform the sealing member with the deformable wiper portion of the sealing member being in contact with the outer threads of the second electrical connector; and advancing the coupling nut over the outer threads of the second electrical connector until the deformable wiper portion of the sealing member is past the outer threads and is non-deformed, such that the deformable wiper portion contacts the outer surface of the intermediate portion of the second electrical connector axially behind the outer threads, thereby sealing the mating interface between the first and second connectors.

In some examples, when the outer surface of the intermediate portion of the second electrical connector is aligned with the sealing member of the coupling nut, the threads of the inner thread portion of the coupling nut fully mates with the outer threads of the first end of the shell.

In another example, the first end of the coupling nut includes an inner groove including a base wall, two sides walls, and an opening, thereby defining a receiving area that is sized and shaped to receive the base of the sealing member. The base of the sealing member is in contact with the base wall of the inner groove, and the wiper portion extends out from the opening of the groove.

In yet another example, the first end of the coupling nut has a mating face. The second end of the coupling nut has a tail face. A distance between the sealing member and the mating face of the coupling nut is smaller than a distance between the sealing member and the tail face of the coupling nut.

In certain examples, the distance between the sealing member and the mating face of the coupling nut is equal to or less than approximately one-ninth of a distance between the mating and tail faces of the coupling nut.

In other examples, the wiper portion of the sealing member includes a tapered edge facing inwardly away from the base of the sealing member.

This summary is not intended to identify all essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Described examples of the present disclosure include an electrical connector that comprises a coupling nut with a sealing member loaded in a front end of the coupling nut. The front end of the coupling nut of the electrical connector provides a mating interface end that mates with a complementary mating connector. The sealing member includes a deformable wiper portion configures to contact an outer surface of the complementary electrical connector, when the two electrical connectors are mated to form an assembly. Accordingly, the mating interface of the electrical connector assembly of the present disclosure is sealed to the outer environment not only when the two connectors are fully mated but also while the two connectors are being mated, due to the design and deformable nature of the sealing member. Also, the threads of the electrical connector (e.g., plug connector) and threads of the complementary electrical connector (e.g., receptacle connector) can be protected from corrosion, such as from external salt water and moisture.

Figure 1:
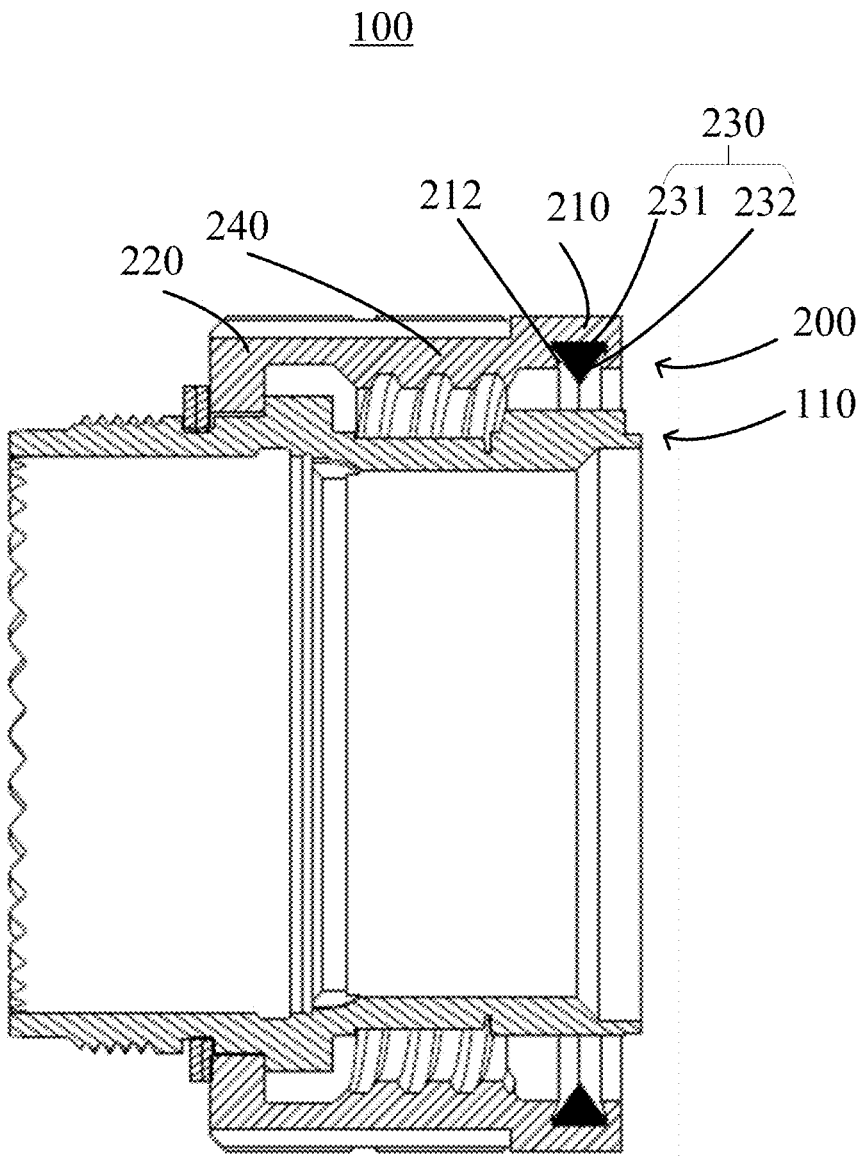
FIG. 1 illustrates a cross-sectional view of an exemplary sealed electrical connector according to the present disclosure.
Figure 2:
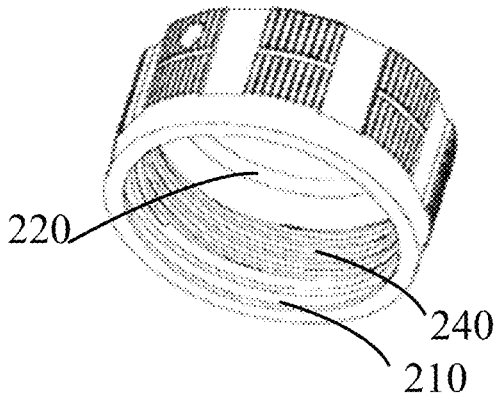
FIG. 2 illustrates a front isometric view of an exemplary coupling nut of the electrical connector illustrated in FIG. 1.
Figure 3:
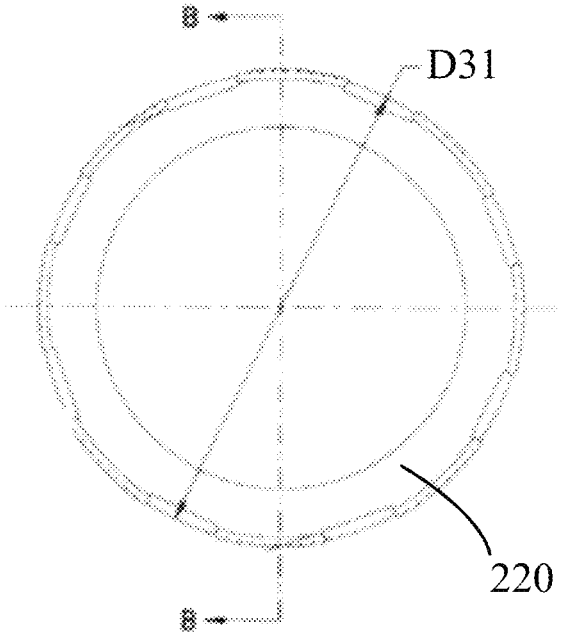
FIG. 3 illustrates a rear elevational view of the coupling nut illustrated in FIG. 2.
Figure 4:
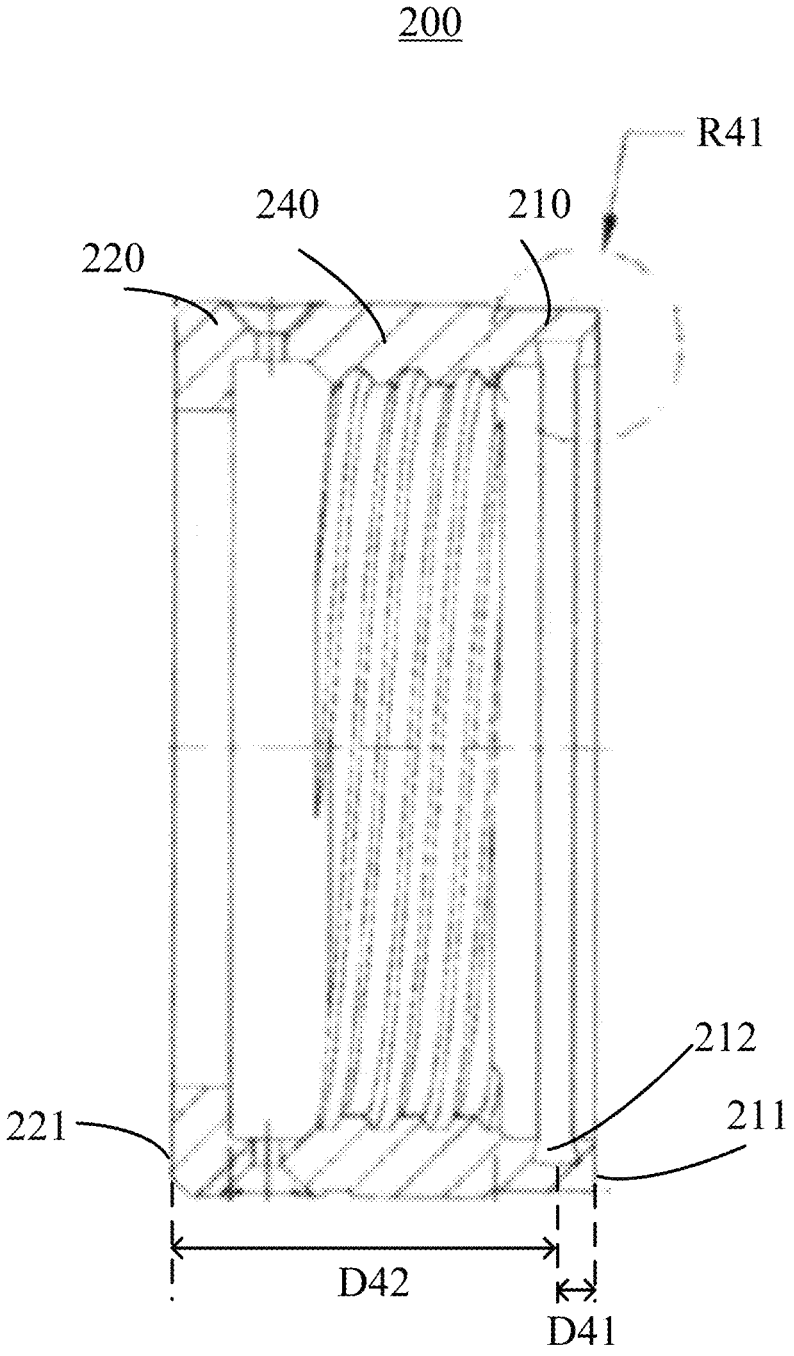
FIG. 4 illustrates a cross-sectional view of the coupling nut along line B-B in FIG. 3.
Figure 7:
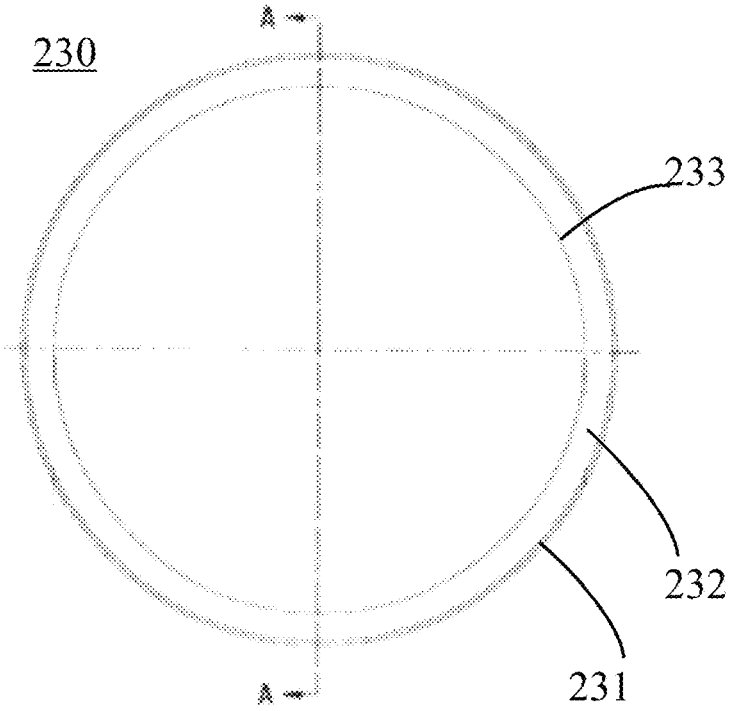
FIG. 7 illustrates an elevational view of an exemplary sealing member of the electrical connector illustrated in FIG. 1.
Figure 8:
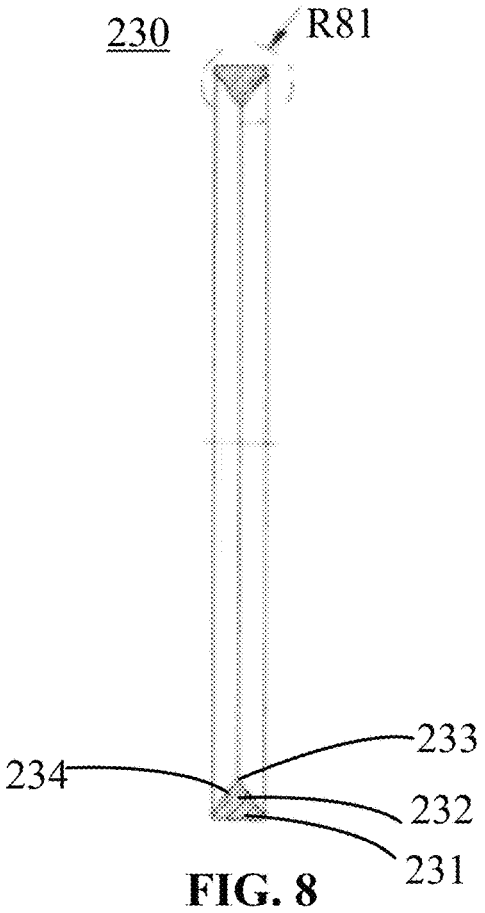
FIG. 8 illustrates a cross-sectional view of the exemplary sealing member along line A-A of FIG. 7.
Figure 9:
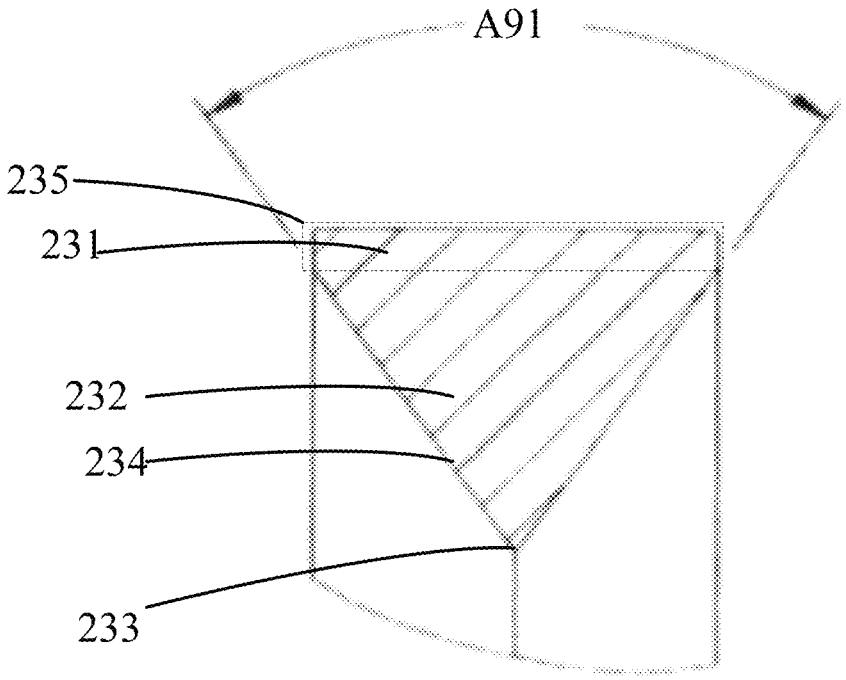
FIG. 9 illustrates a partial enlarged section view of the sealing member of FIG. 8.

FIG. 1 illustrates a cross-sectional view of an exemplary sealed electrical connector 100; FIG. 2 illustrates a front isometric view of an exemplary coupling nut 200 of the connector 100; FIG. 3 illustrates a rear elevational view of the coupling nut 200; and FIG. 4 illustrates a cross-sectional view of the coupling nut 200. Referring to FIGS. 1-4, the electrical connector 100 (e.g., plug connector) generally includes a connector body (e.g., a shell) 110 and the coupling nut 200 configured to at least partially surround the connector body 110. The coupling nut 200 includes a front end 210, a rear end 220, and an inner thread portion 240 located between the front and rear ends 210 and 220. The inner thread portion 240 includes inner threads configured to mate with outer threads of a mating connector (e.g., receptacle connector). The front end 210 is configured to interface with a complementary connector 400 (FIGS. 10 and 11), e.g., receptacle connector. The coupling nut 200 further includes an inner groove 212 and a sealing member 230 located at the coupling nut's front end 210. The inner groove 212 can be sized and shaped to receive and accommodate the sealing member 230. The sealing member 230 generally includes a ring body with a base 231 and a deformable wiper portion 232, as best seen in FIGS. 7-9, which moves between deformed and non-deformed states. The base 231 of the sealing member 230 sits in the inner groove 212.

Referring to FIGS. 3 and 4, the coupling nut 200 has an outer diameter D31, the front end 210 of the coupling nut 200 has a front face 211, also referred to as a "mating face"; and the rear end 220 of the coupling nut 200 has a rear face 221, also referred to as a "tail face." The inner groove 212 of the coupling nut 200 is at or near the mating face 211. That is, a distance D41 between the inner groove 212/the sealing member 230 and the front face 211 is smaller than a distance D42 between the inner groove 212/the sealing member 230 and the rear face 221. In one example, distance D41 is equal to or less than approximately one-ninth of distance D42.

Figure 5:
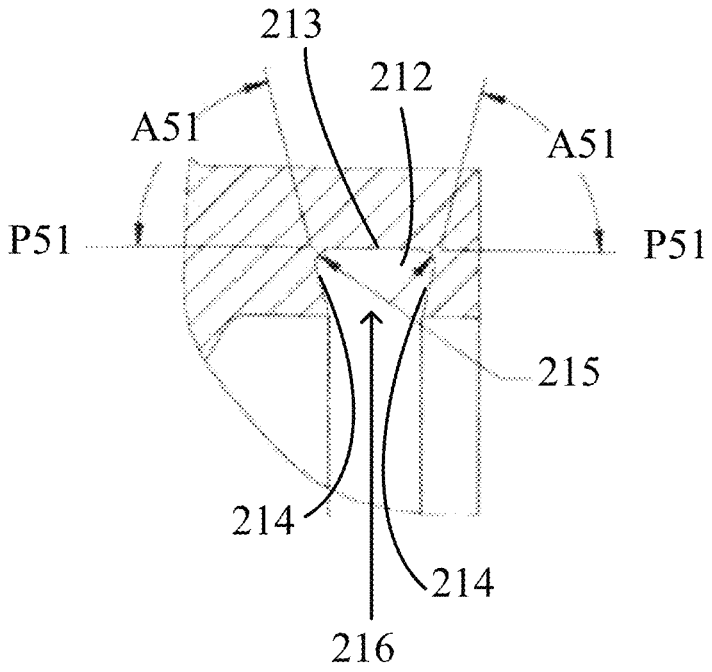
FIG. 5 illustrates a partial enlarged section of the coupling nut in FIG. 4.

FIG. 5 illustrates an enlarged view of region R41 (FIG. 4) of the coupling nut 200. As seen in FIG. 5 the inner groove 212 includes a base wall 213, two side walls 214, and an opening 216 opposite the base wall 213, thereby defining a receiving area that is sized and shaped to receive the base 231 of the sealing member 230. For example, referring to FIGS. 1 and 5, the base 231 of the sealing member 230 is in contact with an inner surface of the coupling nut 200 at the base wall 213 of the inner groove 212, and the deformable wiper portion 232 of the sealing member 230 extends out from the opening 216 of the groove 212. The two side walls 214 of the inner groove 212 can taper inwardly toward one another to generally match the shape of the sealing member 230, which can be, for example, substantially triangular in cross-section. Each side wall 214 and a plane P51-P51, which is generally parallel to a longitudinal axis of the coupling nut 200, may form an angle A51. Angle A51 may be, for example, approximately 75 degrees, or any other suitable acute angle. Each wall of the two walls 214 and the base 213 of the inner groove 212 may has a corner 215. The corner 215 may be, for example, a rounded corner. The two side walls 214 that taper inwardly toward one another may improve retention for the sealing member in the inner groove 212.

Figure 6:
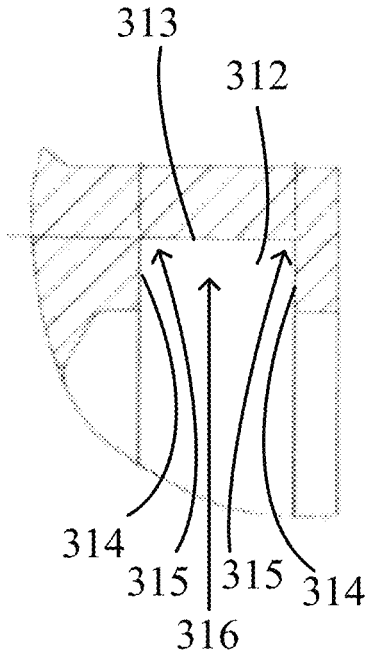
FIG. 6 illustrates a partial enlarged section of another exemplary coupling nut according to the present disclosure.

FIG. 6 illustrates an enlarged view of a region of an alternative inner groove 312 of the coupling nut. Similar to the inner groove 212 describe above, the inner groove 312 of FIG. 6 includes a base wall 313, two side walls 314, and an opening 316, thereby defining a receiving area that is sized and shaped to receive a base of a sealing member, such as the sealing member 230. The two side walls 314 of the inner groove 312 may be substantially parallel to one another. Each of the two side walls 314 and the base wall 313 of the inner groove 312 define corners 315 therebetween. Each corner 315 may be, for example, a right-angle corner. The two substantially parallel side walls 314 of the inner groove 312 may facilitate a smooth installation of a sealing member. In some examples, the sealing member 230 may be manufactured separately with respect to the coupling nut (e.g., 200) and adhered into an inner groove (e.g., 212, 312) of a coupling nut (e.g., 200) by using an epoxy; or may be directly molded into the inner groove of the coupling nut without the use of an epoxy.

FIG. 7 illustrates an elevational view of the exemplary sealing member 230; FIG. 8 illustrates a cross-sectional view of the exemplary sealing member 230; and FIG. 9 illustrates an enlarged view of region R81 (FIG. 8) of the sealing member 230. The sealing member 230 with its deformable wiper portion 232 may be configured to flex between deformed and non-deformed states when coupling the coupling nut 200 to a mating connector.

The deformable wiper portion 232 of the sealing member 230 extends radially inwardly from the base wall 213 of the coupling nut's inner groove 212. The deformable wiper portion 232 includes tapered edges 234 facing inwardly away from the base 231 of the sealing member 230. The tapered edges 234 meet at a tip 233 and correspond to an edge angle A91, as seen in FIG. 9. The edge angle A91 may be, for example, approximately 70 degrees, or any other suitable angle. The shape, size, and edge angle A91 of deformable wiper portion 232 may be chosen, such that deformable wiper portion 232 can deform and bypass the threads of the complementary electrical connector (e.g., receptacle connector) during the mating process and further return to its non-deformed state to seal on outer surface of the complementary electrical connector. A cross-section of the sealing member 230 across a plane (e.g., plane A-A) generally parallel to the longitudinal axis of the coupling nut 200 may be substantially triangular in shape at deformable wiper portion 232, and may also include a rectangular portion 235 corresponding to the base 231 (FIG. 9). The tip 233 of the deformable wiper portion 232 may be in a substantially circular shape (FIG. 7).

Figure 10:
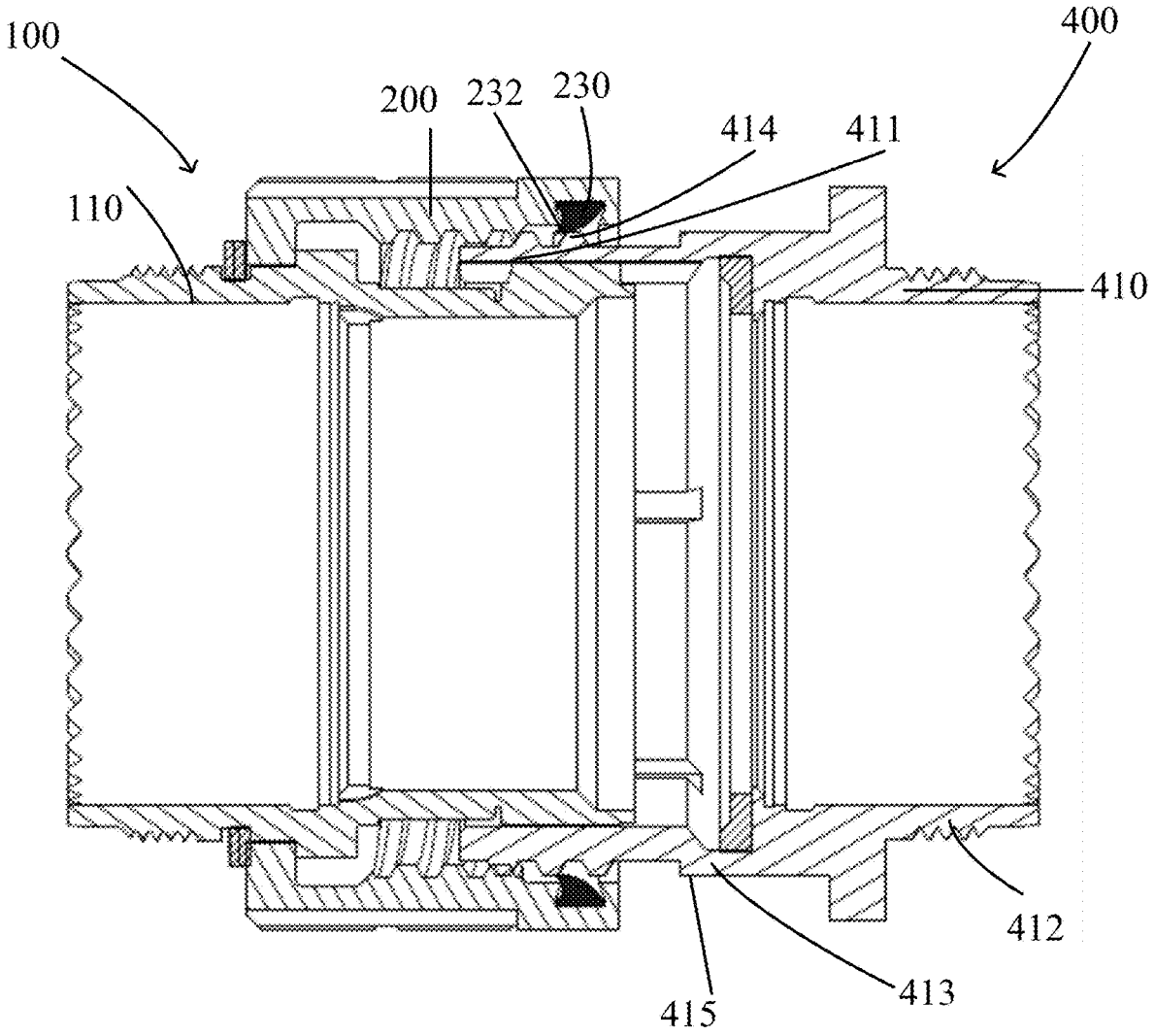
FIG. 10 illustrates the electrical connector of FIG. 1 being mated with a complementary connector to form an electrical connector assembly (e.g., mated pair), showing the sealing member in a deformed state, according to described examples of the present disclosure.
Figure 11:
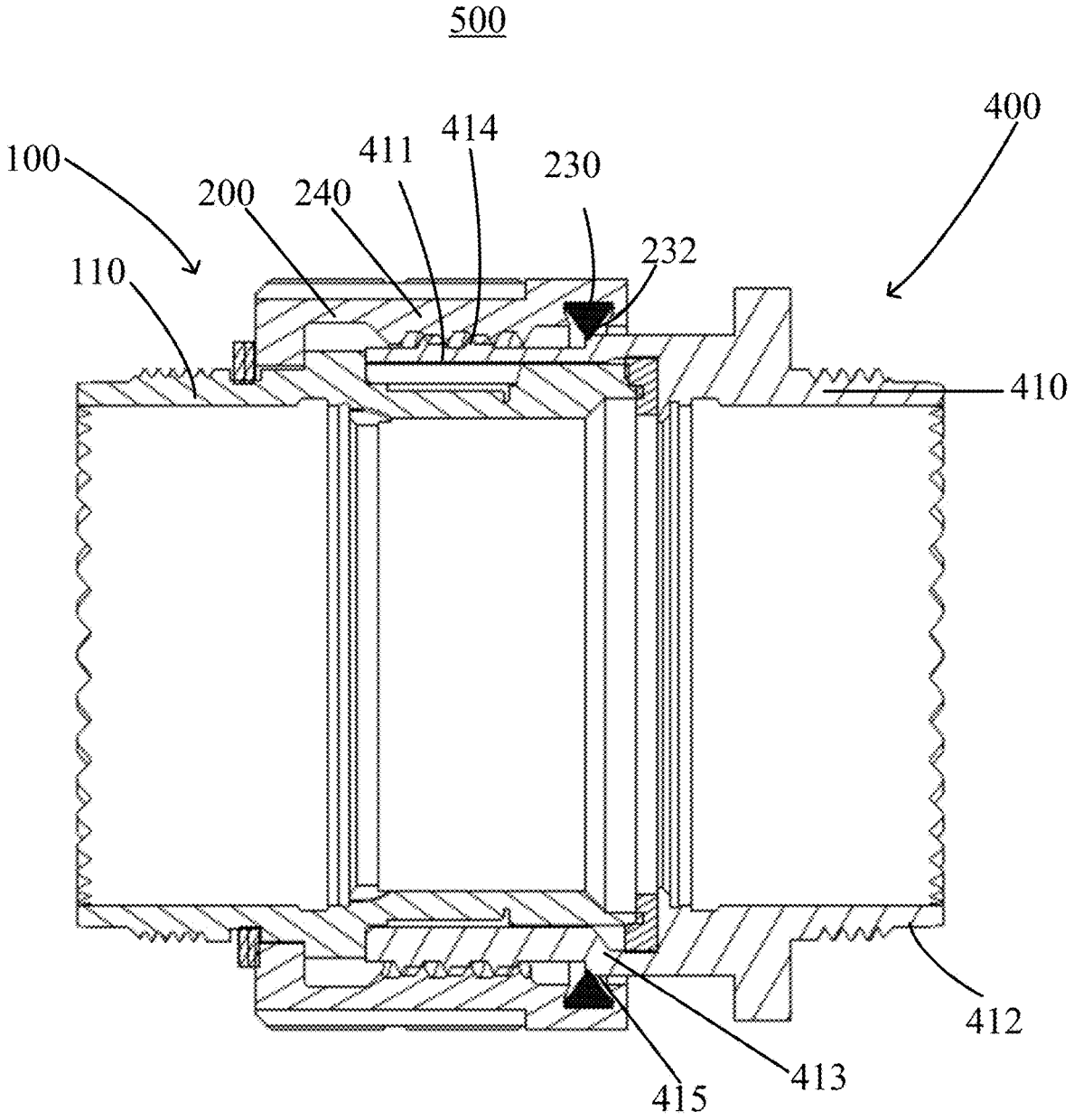
FIG. 11 illustrates the electrical connector assembly of FIG. 10 fully mated, showing the sealed member in a non-deformed state, according to described examples.

FIGS. 10 and 11 illustrates the stages of mating two electrical connectors to form an electrical connector assembly 500 according to the present disclosure. FIG. 10 illustrates the electrical connector 100 being mated or partially engaged with the complementary connector 400, with the sealing member's deformable wiper portion 232 being deformed FIG. 11 illustrates the two electrical connectors 100 and 400 engaged and fully mated to form the electrical connector assembly 500, with the sealing member's deformable wiper portion 232 not deformed.

Figure 12:
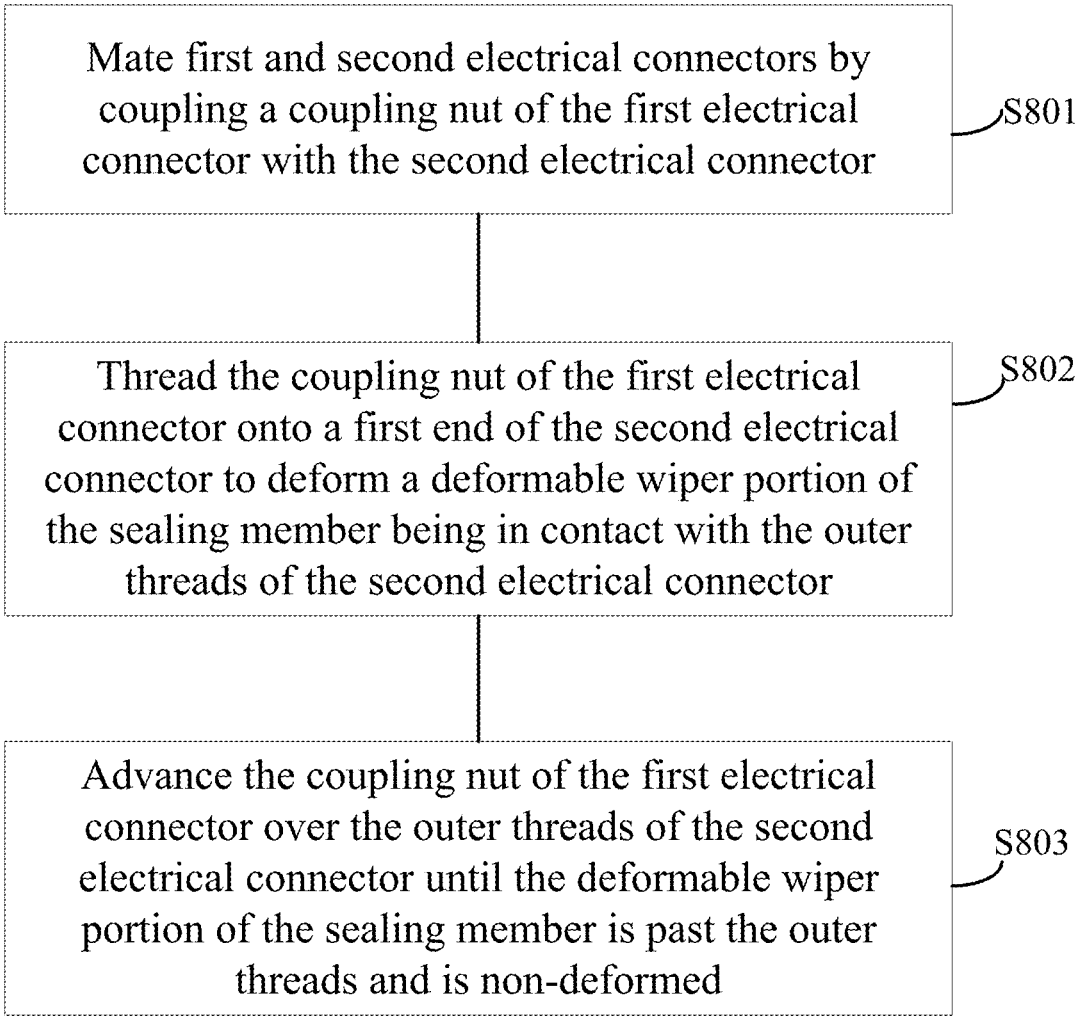
FIG. 12 illustrates a flowchart of an exemplary method for sealing an electrical connector assembly according to described examples.

The complementary electrical connector (e.g., receptacle connector) 400 includes a shell 410. The shell 410 has a first end 411, an opposing second end 412, and an intermediate portion 413 between the first and second ends 411, 412. The first end 411 has outer threads 414 on an outer surface of the first end 411. The intermediate portion 413 has an outer surface spaced axially apart from the threads 414 of the first end 411 of the electrical connector 400. FIG. 12 illustrates a flowchart of an exemplary method for sealing an electrical connector assembly. At S801, a first electrical connector (e.g., a plug connector) and a second electrical connector (e.g., a receptacle connector) are mated by coupling a coupling nut of the first electrical connector (e.g., the electrical connector 100) with the second electrical connector (e.g., the electrical connector 400), thereby defining a mating interface of the assembly. For example, the coupling nut 200 of the electrical connector 100 may be coupled with the electrical connector 400 in order to mate two electrical connectors 100 and 400.

At S802, the coupling nut of the first electrical connector is threaded onto a first end of the second electrical connector to deform a deformable wiper portion of the sealing member being in contact with the outer threads of the second electrical connector.

At S803, the coupling nut of the first electrical connector is advanced over the outer threads of the second electrical connector until the deformable wiper portion of the sealing member is past the outer threads and is non-deformed, such that the deformable wiper portion contacts the outer surface of the intermediate portion of the second electrical connector axially behind the outer threads of the second electrical connector.

For example, referring to FIG. 10, the coupling nut 200 of the electrical connector 100 is threaded onto the first end 411 of the electrical connector 400 to deform the deformable wiper portion 232 of the sealing member 230 being in contact with the outer threads 414 of the second electrical connector 400.

For example, referring to FIGS. 10 and 11, the coupling nut 200 of the electrical connector 100 is advanced over the outer threads 414 of the first end 411 of the complementary electrical connector 400 when mating the two connectors, thereby deforming the wiper portion 232 of the sealing member 230 against the threads. This keeps the interface between the connectors 100 and 200 sealed while in the process of mating the connectors. The coupling nut 200 is advanced over the connector 400 until the deformable wiper portion 232 of the sealing member 230 is past and drops behind the outer threads 414 and is no longer deformed, i.e. non-deformed. At this stage the deformable wiper portion 232 contacts the outer surface 415 of the intermediate portion 413 of the electrical connector 400 axially behind the outer threads 414 of the electrical connector 400 to seal the mating interface of the fully mated connector assembly 500. Accordingly, the threads 414 of the electrical connector 400 mate with inner threads of the inner thread portion 240 of the electrical connector 100 to form the mated connector assembly 500.

In FIG. 11, the electrical connectors 100 and 400 are mated; and the electrical connector assembly 500, that includes the electrical connectors 100 and 400, is sealed, with the deformable wiper portion 232 contacting the outer surface 415 of the intermediate portion 413 of the electrical connector 400. By the contact between the deformable wiper portion 232 of the sealing member 230 and the outer surface of the intermediate portion 413 of the electrical connector 400, the threads 414 of the electrical connector 400 and the inner threads of the inner thread portion 240 of the electrical connector 100 may be protected from the outdoor environment, e.g., external salt, water, and/or moisture. The sealing member 230 is front loaded in the coupling nut 100, so as to protect the threads 414 of the electrical connector 400 and the inner threads of the inner thread portion 240 and maintain grounding and electromagnetic interference (EMI) shielding functionality of the electrical connector assembly 500. Accordingly, the electrical connector assembly 500 can withstand longer duration in salt spray/corrosive atmospheres, while still maintaining grounding and electromagnetic interference (EMI) shielding functionality.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as front, rear, parallel, perpendicular, etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. An electrical connector, comprising:

a coupling nut configured to at least partially surround a connector body, the coupling nut including:

a first end and a second opposing end, the first end being configured to interface with a mating connector;

an inner thread portion located between the first and second ends; and a sealing member located at the first end, the sealing member having a base and a deformable wiper portion, the sealing member being configured to flex between deformed and non-deformed states when coupling the coupling nut to the mating connector, wherein the base of the sealing member is in contact with an inner surface of the first end and the deformable wiper portion extends radially inwardly from the base.

2. The electrical connector of claim 1, wherein:

the first end of the coupling nut includes an inner groove that has a base wall, two side walls, and an opening, wherein the base wall, the two side walls, and the opening define a receiving area that is sized and shaped to receive the base of the sealing member; and wherein the base of the sealing member is in contact with the base wall of the inner groove, and the deformable wiper portion of the sealing member extends out from the opening of the groove.

3. The electrical connector of claim 2, wherein the two side walls of the inner groove taper inwardly toward one another.

4. The electrical connector of claim 2, wherein the two side walls of the inner groove are substantially parallel to one another.

5. The electrical connector of claim 1, wherein:

the first end of the coupling nut has a mating face;

the second end of the coupling nut has a tail face; and a distance between the sealing member and the mating face of the coupling nut is smaller than a distance between the sealing member and the tail face of the coupling nut.

6. The electrical connector of claim 1, wherein the distance between the sealing member and the mating face of the coupling nut is equal to or less than approximately one-ninth of a distance between the mating and tail faces.

7. The electrical connector of claim 1, wherein the deformable wiper portion of the sealing member includes a tapered edge facing inwardly away from the base of the sealing member.

8. The electrical connector of claim 1, wherein a cross-section of the sealing member is substantially triangular in shape.

9. The electrical connector of claim 1, wherein the sealing member is positioned between the inner thread portion and a mating face of the first end along a longitudinal axis of the coupling nut.

10. An electrical connector assembly, comprising:

a first electrical connector including:

a body and a coupling nut that at least partially surrounds the body and has a longitudinal axis, the coupling nut including:

a first end and a second opposing end, an inner thread portion located between the first and second ends, and a sealing member located at the first end, the sealing member having a base and a deformable wiper portion, wherein the base of the sealing member is in contact with an inner surface of the first end, and the deformable wiper portion extends radially inwardly from the base; and a second electrical connector including:

a shell that has a first end with outer threads, and an opposing second end, the first end being configured to mate with the coupling nut of the first electrical connector, and wherein:

the inner thread portion of the coupling nut mates with the outer threads of the first end of the second electrical connector; and when mating the first and second electrical connectors, the sealing member is configured to flex between deformed and non-deformed states and the deformable wiper portion of the sealing member of the coupling nut is in contact with an outer surface of the shell of the second electrical connector.

11. The assembly of claim 10, wherein when in the non-deformed state, the deformable wiper portion of the sealing member contacts the outer surface at a position axially spaced from and behind the outer threads of the shell of the second electrical connector.

12. The assembly of claim 10, wherein when in the deformed state, the deformable wiper portion of the sealing member of the coupling nut is in contact with the outer surface at the outer threads of the shell of the second electrical connector.

13. The electrical connector of claim 10, wherein:

the first end of the coupling nut includes an inner groove including a base wall, two sides walls, and an opening, thereby defining a receiving area that is sized and shaped to receive the base of the sealing member; and wherein the base of the sealing member is in contact with the base wall of the inner groove, and the deformable wiper portion extends out from the opening of the groove.

14. The assembly of claim 10, wherein the two side walls taper inwardly toward one another.

15. The assembly of claim 10, wherein:

the first end of the coupling nut has a mating face;

the second end of the coupling nut has a tail face; and a distance between the sealing member and the mating face of the coupling nut is smaller than a distance between the sealing member and the tail face of the coupling nut.

16. The assembly of claim 10, wherein the distance between the sealing member and the mating face of the coupling nut is equal to or less than approximately one-ninth of a distance between the mating and tail faces of the coupling nut.

17. The assembly of claim 10, wherein the deformable wiper portion of the sealing member includes a tapered edge facing inwardly away from the base of the seal.

18. The assembly of claim 10, wherein a tip of the tapered edge is in a substantially circular shape across a plane orthogonal to the longitudinal axis of the coupling nut.

19. The assembly of claim 10, wherein a cross-section of the sealing member is substantially triangular in shape.

20. The assembly of claim 10, wherein when in the non-deformed state, the deformable wiper portion of the sealing member is axially spaced apart from and behind the outer threads of the first end of the shell of the second electrical connector along the longitudinal axis of the coupling nut.

21. A method of sealing an electrical connector assembly, comprising:

mating first and second electrical connectors by coupling a coupling nut of the first electrical connector with the second electrical connector, thereby defining a mating interface of the assembly, wherein the coupling nut includes:

a first end and a second opposing end, an inner thread portion between the first and second ends, and a sealing member at the first end and having a base and a deformable wiper portion that is configured to flex between deformed and non-deformed states when mating the first and second electrical connectors, and the second electrical connector includes a shell having:

a first end having outer threads on an outer surface of the first end and an opposing second end, and an intermediate portion between the first and second ends and having an outer surface spaced axially apart from the threads of the first end of second electrical connector;

threading the coupling nut onto the first end of the second electrical connector to deform the sealing member with the deformable wiper portion of the sealing member being in contact with the outer threads of the second electrical connector; and advancing the coupling nut over the outer threads of the second electrical connector until the deformable wiper portion of the sealing member is past the outer threads and is non-deformed, such that the deformable wiper portion contacts the outer surface of the intermediate portion of the second electrical connector axially behind the outer threads, thereby sealing the mating interface between the first and second connectors.

22. The method of claim 21, wherein when the outer surface of the intermediate portion of the second electrical connector is aligned with the sealing member of the coupling nut, the threads of the inner thread portion of the coupling nut fully mates with the outer threads of the first end of the shell.

23. The method of claim 21, wherein:

the first end of the coupling nut includes an inner groove including a base wall, two sides walls, and an opening, thereby defining a receiving area that is sized and shaped to receive the base of the sealing member; and the base of the sealing member is in contact with the base wall of the inner groove, and the wiper portion extends out from the opening of the groove.

24. The method of claim 21, wherein:

the first end of the coupling nut has a mating face;

the second end of the coupling nut has a tail face; and a distance between the sealing member and the mating face of the coupling nut is smaller than a distance between the sealing member and the tail face of the coupling nut.

25. The method of claim 21, wherein the distance between the sealing member and the mating face of the coupling nut is equal to or less than approximately one-ninth of a distance between the mating and tail faces of the coupling nut.

26. The method of claim 21, wherein the wiper portion of the sealing member includes a tapered edge facing inwardly away from the base of the sealing member.

* * * * *